US008461948B2

(12) United States Patent
Pulskamp et al.

(10) Patent No.: US 8,461,948 B2
(45) Date of Patent: Jun. 11, 2013

(54) ELECTRONIC OHMIC SHUNT RF MEMS SWITCH AND METHOD OF MANUFACTURE

(75) Inventors: Jeffrey S. Pulskamp, Leesburg, VA (US); Daniel C. Judy, Odenton, MD (US); Ronald G. Polcawich, Derwood, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 1496 days.

(21) Appl. No.: 11/860,765

(22) Filed: Sep. 25, 2007

(65) Prior Publication Data

US 2012/0273331 A1 Nov. 1, 2012

(51) Int. Cl.
*H01H 51/22* (2006.01)

(52) U.S. Cl.
USPC ..... 335/78; 200/181

(58) Field of Classification Search
USPC ..... 335/78–80; 200/181; 438/51, 64; 216/13
See application file for complete search history.

(56) References Cited

U.S. PATENT DOCUMENTS

| | | | | |
|---|---|---|---|---|
| 5,619,061 | A | 4/1997 | Goldsmith et al. | |
| 6,020,564 | A | 2/2000 | Wang et al. | |
| 6,100,477 | A | 8/2000 | Randall et al. | |
| 6,218,911 | B1 | 4/2001 | Kong et al. | |
| 6,229,683 | B1 | 5/2001 | Goodwin-Johansson | |
| 6,621,134 | B1 * | 9/2003 | Zurn | 257/415 |
| 6,621,387 | B1 | 9/2003 | Hopcroft | |
| 6,639,488 | B2 * | 10/2003 | Deligianni et al. | 333/101 |
| 6,657,525 | B1 | 12/2003 | Dickens et al. | |
| 6,740,946 | B2 * | 5/2004 | Funaki | 257/415 |
| 6,777,765 | B2 | 8/2004 | Chen et al. | |
| 6,919,784 | B2 | 7/2005 | Feng et al. | |
| 6,998,946 | B2 | 2/2006 | Feng et al. | |
| 7,414,500 | B2 * | 8/2008 | De Los Santos | 335/78 |
| 7,545,246 | B2 * | 6/2009 | Kim et al. | 335/78 |
| 7,834,722 | B2 * | 11/2010 | Millet | 335/78 |
| 7,884,689 | B2 * | 2/2011 | Cetiner et al. | 335/78 |
| 8,018,308 | B2 * | 9/2011 | Kwon et al. | 335/78 |

OTHER PUBLICATIONS

U.S. Appl. No. 11/347,291, filed Feb. 6, 2006, Pulskamp et al.
U.S. Appl. No. 11/518,746, filed Sep. 7, 2006, Pulskamp et al.
Muldavin et al., "Novel DC-Contact MEMS Shunt Switches and High-Isolation Series/Shunt Designs," In: Gallium Arsenide Applications Symposium, GAAS 2001, Sep. 28-24, 2001, 3 pages.

(Continued)

*Primary Examiner* — Bernard Rojas
(74) *Attorney, Agent, or Firm* — Avrom David Spevack; Eric B. Compton

(57) ABSTRACT

An electrostatic ohmic shunt radio frequency (RF) microelectromechanical system (MEMS) switch and method of manufacturing includes a co-planar waveguide (CPW) transmission line comprising a plurality of slots and a plurality of pillars, wherein a space between successive ones of the plurality of pillars is defined by one of the plurality of slots; a plurality of electrodes positioned in the slots; a conductive contact beam elevated over the CPW transmission line and the plurality of electrodes; and a plurality of conductive contact dimples positioned between the conductive contact beam and the CPW transmission line, wherein the plurality of pillars are adapted to prevent physical contact between the plurality of electrodes and the conductive contact beam.

20 Claims, 12 Drawing Sheets

OTHER PUBLICATIONS

Jensen et al., "Effect of Nanoscale Heating on Electrical Transport in RF MEMS Switch Contacts," Journal of Microelectromechanical Systems, vol. 14, No. 5, Oct. 2005, pp. 935-946.

Jensen et al., "Integrated Electrothermal Modeling of RF MEMS Switches for Improved Power Handling Capability," IEEE, 2003, 2 pages.

Tan et al., "A DC-Contact MEMS Shunt Switch," IEEE Microwave and Wireless Components Letters, vol. 12, No. 6, pp. 212-214, Jun. 2002.

Rebeiz, G., "RF MEMS—Theory, Design, and Technology," pp. 128-130, John Wiley & Sons, Inc., 2003.

* cited by examiner

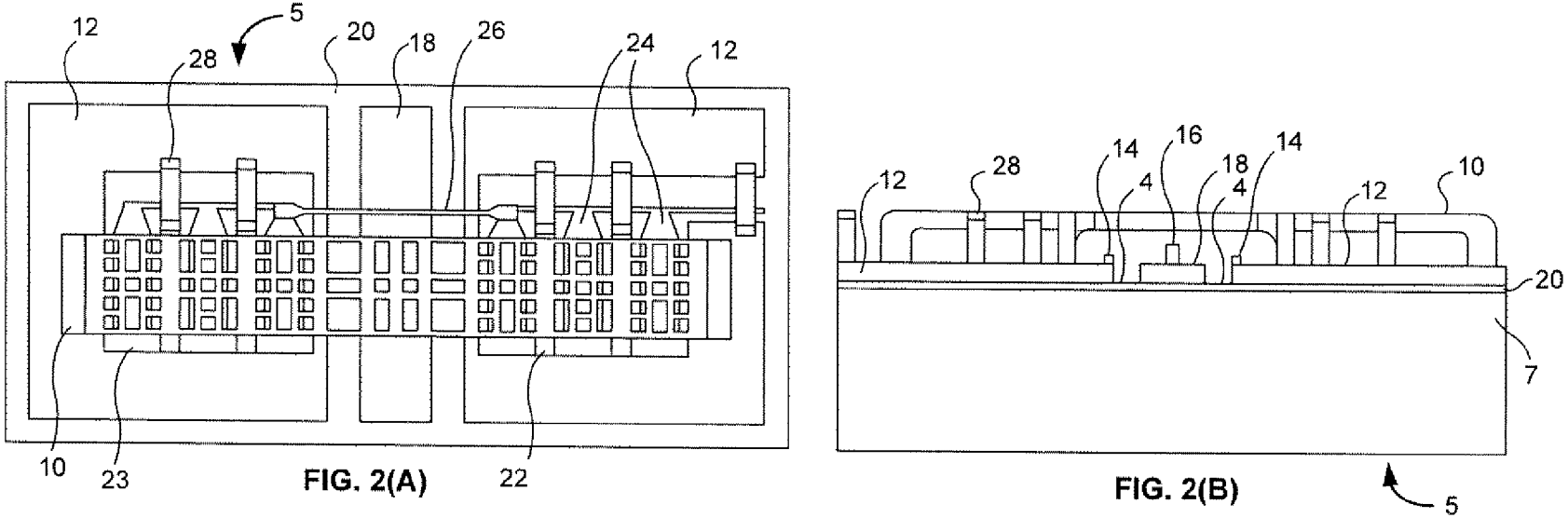
FIG. 2(A)
FIG. 2(B)
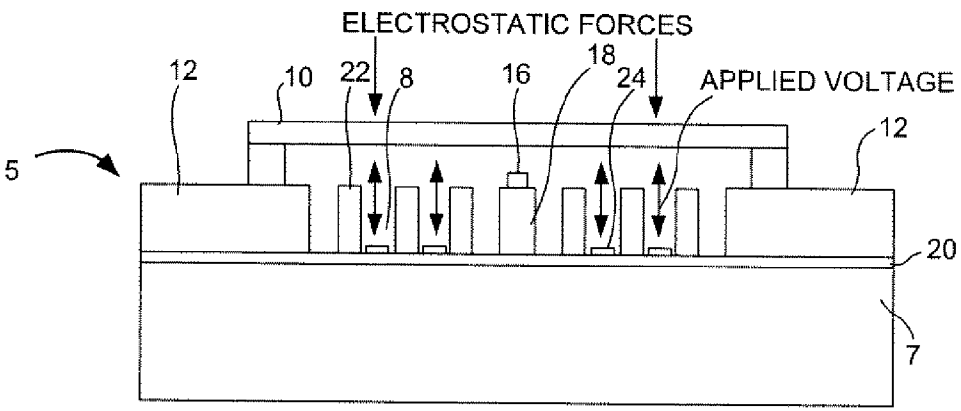
FIG. 3

ELECTRONIC OHMIC SHUNT RF MEMS SWITCH AND METHOD OF MANUFACTURE

GOVERNMENT INTEREST

The embodiments described herein may be manufactured, used, and/or licensed by or for the United States Government.

BACKGROUND

1. Technical Field

The embodiments herein generally relate to microelectronic systems, and, more particularly, to radio frequency (RF) microelectromechanical systems (MEMS) switches.

2. Description of the Related Art

RF MEMS switches have recently received considerable attention. Generally desirable for their extremely low insertion loss, extreme linearity, minimal intermodulation product generation, and power consumption characteristics; RF MEMS switches posses many advantages over their competing technologies. RF MEMS switches fall into two basic categories: series/shunt RF configurations, and ohmic/capacitive contact behaviors. RF MEMS series switches have been demonstrated with both ohmic and capacitive contacts.

However, the majority of RF MEMS shunt switches have been configured with capacitive contact architectures. Many successful switches of this kind have been demonstrated over the years but, generally, all inherently suffer from inadequate performance below X-band (<10 GHz) and are subject to their own failure mechanisms.

DC-contact, or ohmic. RF MEMS shunt switches have also been demonstrated. These switches utilize a free, hinge-constrained, contact beam with separate actuation pads. However, physical contact still occurs between the actuation electrodes and the contact beam; an undesirable trait with respect to switch lifetime. The inductance of such a design also tends to hamper the high frequency operation of the switch. Moreover, the lack of rigid mechanical constraints within the hinge region tends to make this design exceedingly susceptible to performance degradation due to vibration or even simple rigid body motion of the parent system and limits its attainable switching speed. The lack of rigid mechanical constraints within the hinge region also, in all likelihood, results in significant device-to-device performance variability. All of these factors tend to limit the operational lifetime of the switch as well as its usefulness in military applications.

Other designs use a DC-contact RF MEMS shunt switch that utilizes a suspended RF center conductor contact beam. Bias electrodes are placed directly beneath this structure to enable maximum (with respect to geometric considerations of load application only) actuation force/unit voltage. This design prevents direct physical contact between the actuation electrodes and the contact beam. However, to attain this feature with the suspended RF center conductor contact beam design, the actuation electrodes must be present in the coplanar waveguide (CPW) gaps. This leads to significant degradation in the return loss of the switch, particularly at higher frequencies. The presence of this metal in the CPW gaps prevents proper impedance matching over a large range of frequencies and contributes to low return loss. Accordingly, there remains a need for a new electrostatic ohmic shunt RF MEMS switch that achieves an improved insertion loss performance over conventional switches.

SUMMARY

In view of the foregoing, an embodiment herein provides an electrostatic ohmic shunt RF MEMS switch comprising a centrally located and structurally continuous RF conductor; a pair of conductor ground planes flanking the RF conductor, wherein the pair of conductor ground planes comprise a first ground plane and a second ground plane each comprising a plurality of slots configured therein; a plurality of electrodes positioned in the slots; a conductive contact beam elevated over the RF conductor, the pair of conductor ground planes, and the plurality of electrodes, wherein the contact beam is attached to the pair of conductor ground planes; a plurality of mechanical ground stops extending from the pair of conductor ground planes, wherein a space between successive ones of the plurality of mechanical ground stops is defined by one of the plurality of slots, wherein the plurality of mechanical ground stops are adapted to prevent physical contact between the plurality of electrodes and the conductive contact beam; and a plurality of conductive contact dimples positioned between the conductive contact beam and each of the RF conductor and the pair of conductor ground planes.

The switch may further comprise a plurality of ground straps adapted to tie adjacent sections of the pair of conductor ground planes together. Moreover, the switch may further comprise a bias line adapted to connect the plurality of electrodes to one another. Additionally, the switch may further comprise a bias line air bridge adapted to connect the plurality of electrodes and the bias line located on the first ground plane to the plurality of electrodes and the bias line located on the second ground plane.

Preferably, the plurality of conductive contact dimples are adapted to transmit electric current between the conductive contact beam and each of the RF conductor and the pair of conductor ground planes when voltage is applied between the pair of conductor ground planes and the plurality of electrodes. Furthermore, the RF conductor preferably comprises a narrowed central portion located underneath the contact beam to reduce an excess capacitance induced by the contact beam. Moreover, the plurality of conductive contact dimples preferably comprise a first set of conductive contact dimples adapted to connect the pair of conductor ground planes with the contact beam; and a second set of conductive contact dimples adapted to connect the RF conductor with the contact beam, wherein the first set of conductive contact dimples are adapted to reduce a parasitic inductance induced by the contact beam.

Another embodiment provides an electrostatic ohmic shunt RF MEMS switch comprising a CPW transmission line comprising a plurality of slots and a plurality of pillars, wherein a space between successive ones of the plurality of pillars is defined by one of the plurality of slots; a plurality of electrodes positioned in the slots; a conductive contact beam elevated over the CPW transmission line and the plurality of electrodes; and a plurality of conductive contact dimples positioned between the conductive contact beam and the CPW transmission line, wherein the plurality of pillars are adapted to prevent physical contact between the plurality of electrodes and the conductive contact beam.

Preferably, the CPW transmission line comprises a centrally located and structurally continuous RF conductor; a pair of conductor ground planes flanking the RF conductor, wherein the pair of conductor ground planes comprise a first ground plane and a second ground plane each comprising the plurality of slots configured therein; and a plurality of ground straps adapted to tie adjacent sections of the pair of conductor ground planes together, wherein the contact beam is attached to the pair of conductor ground planes. The switch may further comprise a bias line adapted to connect the plurality of electrodes to one another. Also, the switch may further comprise a bias line air bridge adapted to connect the plurality of electrodes and the bias line located on the first ground plane to the plurality of electrodes and the bias line located on the second ground plane.

Preferably, the plurality of conductive contact dimples are adapted to transmit electric current between the conductive contact beam and the CPW transmission line when voltage is applied between the pair of conductor ground planes and the plurality of electrodes. Moreover, the RF conductor preferably comprises a narrowed central portion located underneath the contact beam to reduce an excess capacitance induced by the contact beam. Furthermore, the plurality of conductive contact dimples preferably comprise a first set of conductive contact dimples adapted to connect the pair of conductor ground planes with the contact beam; and a second set of conductive contact dimples adapted to connect the RF conductor with the contact beam, wherein the first set of conductive contact dimples are adapted to reduce a parasitic inductance induced by the contact beam.

Another embodiment provides a method of manufacturing an electrostatic ohmic shunt RF MEMS switch, wherein the method comprises forming a CPW transmission line comprising a plurality of slots and a plurality of pillars, wherein a space between successive ones of the plurality of pillars is defined by one of the plurality of slots; positioning a plurality of electrodes in the slots; elevating a conductive contact beam over the CPW transmission line and the plurality of electrodes; and positioning a plurality of conductive contact dimples between the conductive contact beam and the CPW transmission line, wherein the plurality of pillars are adapted to prevent physical contact between the plurality of electrodes and the conductive contact beam.

Preferably, the forming of the CPW transmission line comprises configuring a centrally located and structurally continuous RF conductor; flanking a pair of conductor ground planes adjacent to the RF conductor, wherein the pair of conductor ground planes comprise a first ground plane and a second ground plane each comprising the plurality of slots configured therein; and configuring a plurality of ground straps to tie adjacent sections of the pair of conductor ground planes together, wherein the contact beam is attached to the pair of conductor ground planes. The method may further comprise forming a bias line to connect the plurality of electrodes to one another. Moreover, the method may further comprise forming a bias line air bridge to connect the plurality of electrodes and the bias line located on the first ground plane to the plurality of electrodes and the bias line located on the second ground plane.

Preferably, the plurality of conductive contact dimples are adapted to transmit electric current between the conductive contact beam and the CPW transmission line when voltage is applied between the pair of conductor ground planes and the plurality of electrodes. Additionally, the RF conductor preferably comprises a narrowed central portion located underneath the contact beam to reduce an excess capacitance induced by the contact beam, and wherein the plurality of conductive contact dimples comprise a first set of conductive contact dimples adapted to connect the pair of conductor ground planes with the contact beam; and a second set of conductive contact dimples adapted to connect the RF conductor with the contact beam, wherein the first set of conductive contact dimples are adapted to reduce a parasitic inductance induced by the contact beam.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which:

FIG. 2(A) is a schematic diagram illustrating a top-down view of the switch of FIG. 1 according to an embodiment herein;

FIG. 2(B) is a schematic diagram illustrating a profile view of the switch of FIG. 1 according to an embodiment herein;

FIG. 3 is a schematic diagram illustrating the principle of operation of the switch of FIG. 1 according to an embodiment herein;

DETAILED DESCRIPTION OF PREFERRED EMBODIMENTS

Figure 1:
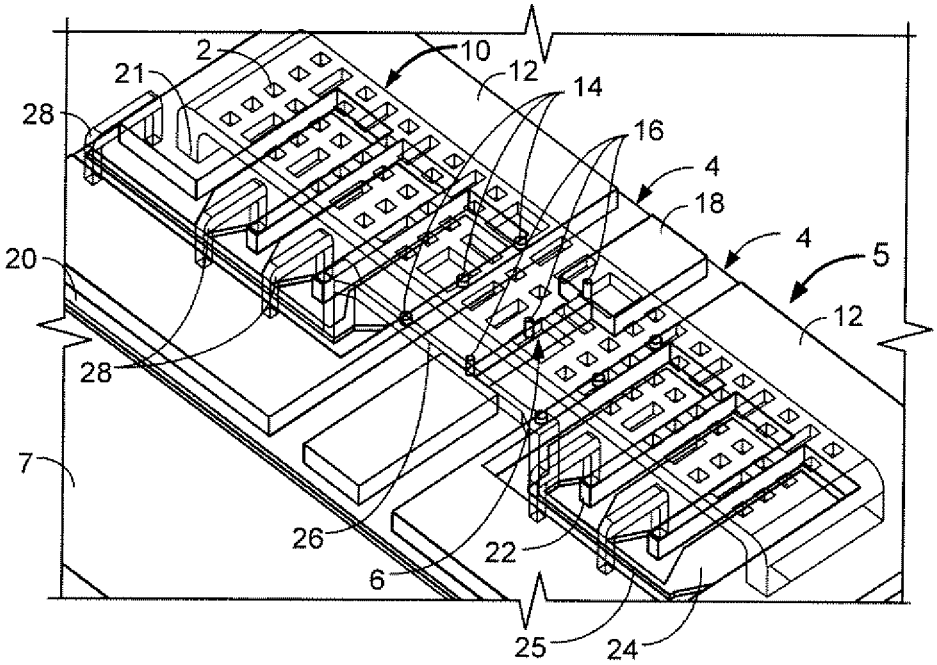
FIG. 1 is a schematic diagram illustrating a perspective view of an electrostatic ohmic shunt RF MEMS switch according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

As mentioned, there remains a need for a new electrostatic ohmic shunt RF MEMS switch that achieves an improved insertion loss performance over conventional switches. The embodiments herein achieve this by providing an electrostatic ohmic shunt RF MEMS switch that has an extremely low, nearly immeasurable, insertion loss, and which has a greatly increased device lifetime compared with conventional switches. Referring now to the drawings, and more particularly to FIGS. 1 through 8, where similar reference characters denote corresponding features consistently throughout the figures, there are shown preferred embodiments.

FIGS. 1 through 3 illustrate a switch 5 according to an embodiment herein. A conductive contact beam 10, illustrated as a wire frame feature (for clarity) in the figures, is mechanically anchored to ground planes 12 (and also sharing the electrical potential) of a Coplanar Waveguide (CPW) geometry RF transmission line (the CPW RF transmission line comprises the ground planes 12 and a center RF conductor 18). The contact beam 10 is elevated above the center RF conductor 18 of the CPW RF transmission line. Bias pads (electrodes) 24 are positioned beneath the contact beam 10 within slots 8 patterned in the ground planes 12. A voltage is applied between the ground planes 12 (and thus the contact beam 10) and the bias pads 24. This voltage generates an electrostatic force that acts to deform the contact beam 10 toward the bias pads 24. At a critical voltage, referred to as the snap-in voltage, the contact beam 10 collapses towards the bias pads 24. Preferably, the thickness of each of the bias pads 24 is less than the thickness of each of the ground planes 12. Therefore, the portions of the ground planes 12 beneath the contact beam 10, referred to as the mechanical ground stops 22 and preferably embodied as pillar-like structures, prevent further deformation and physical contact between the contact beam 10 and the bias pads 24. When this occurs, the center portion of the contact beam 10 makes physical and electrical contact to RF dimples 16 lying atop the narrowed section 6 of the center RF conductor 18 of the CPW RF transmission line and ground plane dimples 14 on the mechanical ground stops 22 directly adjacent to the center RF conductor 18. The dimples 14, 16 provide a means with which electrical current can pass between the contact beam 10 and the CPW RF transmission line. In addition, the ground plane dimples 14 serve to reduce the overall inductance of the contact beam 10 by shortening its effective electrical length to that length between two diametrically opposite ground plane dimples 14. When the switch 5 is unactuated, RF signals propagating along the CPW transmission line are unimpeded and pass through the switch 5. Conversely, when the switch 5 is actuated with the snap-in voltage and the contact beam 10 makes physical and electrical contact with the center RF conductor 18; RF signals propagating along the CPW transmission line are "shunted" to the ground planes 12. This "shunting" ideally prevents any RF signal from traveling past the location of the switch contact; thus turning the signal off. Removing the switch actuation voltage causes the switch's mechanical restoration force to open the switch contact; thus turning on the signal.

The components of the switch 5 are described with more specificity below. The CPW transmission line comprises two ground planes 12 flanking the center RF conductor 18. The CPW transmission line is the path along which RF signals propagate. Preferably, it comprises common transmission line geometry, and the RF line narrows (narrowed section 6) beneath the location of the contact beam 10 to compensate for excess capacitance of the contact beam 10, which reduces the return and insertion loss of the switch 5 by impedance matching the switch 5 to transmission line characteristic impedance. Preferably, the CPW transmission line comprises pure electron beam evaporated gold with a thin titanium adhesion layer. Beneath the CPW transmission line may be a thin layer of silicon dioxide 20 that mitigates bias voltage dependence of the RF performance of the transmission line. This is referred to as the "dielectric underlayer" 20. Next, the CPW transmission line comprises ground straps 28, which tie the adjacent sections of the ground planes 12 around the bias pads 24 to minimize the impact of the ground plane geometric discontinuity on the characteristic impedance of the transmission line.

The bias pads 24 are electrodes for applying voltage to generate the electrostatic actuation forces. Traditional RF MEMS shunt switches apply the actuation voltage between the ground planes and the center RF conductor. However, this traditional configuration is viable for capacitive switching but not for ohmic, or metal-to-metal, contacts. The contacts would simply weld together given the low contact resistance and the relatively large voltages applied between them. Accordingly, the switch 5 provided by the embodiments herein provides a separate electrode 24 with which to apply that voltage; eliminating the large voltages across the metal-to-metal contacts. This feature allows for an electrostatic ohmic shunt RF MEMS switch 5 in accordance with the embodiments herein. A structural beam, referred to as the "bias line air bridge" 26, connects the bias lines 25 that are connected to the bias pads 24 located within each ground plane 12. The bias line air bridge 26 allows for a single bias line to actuate sides of the contact beam 10 on either side of the center RF conductor 18 and thus simplifies the biasing scheme especially for larger circuits of which the switch 5 may be a component. Preferably, platinum is used as the bias pad 24 material with a titanium adhesion under-layer. Furthermore, in another embodiment, one may use a dielectric 34 (for example, shown in FIGS. 4(K) and 4(L)) over the bias pads 24 to reduce the probability of shorting between the contact beam 10 and the bias pads 24. In another, embodiment a resistive material, such as NiCr, could be used to form the bias lines 25 so as to provide resistive isolation of the bias line 25 from the RF current flowing on the contact beam 10.

The mechanical ground stops 22 comprise those portions of the ground planes 12 beneath the contact beam 10, which prevent the contact beam 10 from touching the bias pads 24. One of the primary failure mechanisms with traditional capacitive RF MEMS switches is the build up of charging of the dielectrics used between the contacts. The build-up of electric charges creates an electric field between the dielectric material and the mechanical contact beam. These fields can become large enough to permanently close/open the switch contacts. In order to overcome this, the switch 5 provided by the embodiments herein mitigates the charging effect by preventing the physical contact between the contact beam 10 and the bias pads 24; this reduces the fields within the dielectric thus mitigating the charging phenomenon. In another embodiment, the switch 5 does not include any dielectric material at all; thereby totally eliminating this failure mechanism altogether.

The contact dimples, referred to as the "ground plane dimples" 14, are located on the mechanical ground stops 22 closest to (adjacent to) the narrowed section 6 of the center RF conductor 18. These electrical contacts (ground plane dimples 14) are preferably thinner in height than the contacts (RF dimples 16) on the center RE conductor 18 to ensure that the contact occurs on both sets of dimples 14, 16. The ground plane dimples 14 shorten the effective length of the contact beam 10 and thus greatly reduce the imposed inductance of the contact beam 10. Reducing the induced inductance of the contact beam 10 greatly improves the high frequency performance of the switch 5. The ground plane dimples 14 may comprise platinum with a thin layer of titanium or gold used for adhesion.

The contact beam 10 is preferably embodied as a conductive clamped-clamped structure positioned with its major longitudinal axis perpendicular to the major axis of CPW transmission line (ground planes 12 and center RF conductor 18). Moreover, the contact beam 10 is elevated above the bias pads 24 and the mechanical ground stops 22. As described above, actuation of the contact beam 10 occurs when the snap-in voltage is applied between the contact beam 10 and the bias pads 24. When the contact beam 10 makes contact with the contacts (RF dimples 16) located on the narrowed section 6 of the center RF conductor 18 of the CPW transmission line and the ground plane dimples 14, the RE signal propagating along the line is "shunted" to the ground planes 12 (thus turning the signal off). Furthermore, pure gold may used as the material for the contact beam 10.

Each of the contact dimples (ground plane dimples 14 and RF dimples 16) are embodied as small circular features either on the ground planes 12 or on the center RF conductor 18 and in both cases, the dimples 14, 16 are located beneath the contact beam 10. The dimples 14, 16 provide the specific location of contact, whereby a smaller contact area increases contact pressure and consequently lowers the contact resistance of the switch 5. The lower contact resistance thereby increases the isolation of the switch 5 in the closed state. In one embodiment, platinum is used as the material of the dimples 14, 16 with a thin titanium or gold layer used for adhesion.

According to an embodiment herein, the switch 5 may be arranged according to the following approximate configurations. The CPW transmission line preferably includes three parallel conductors (two ground planes 12 and center RF conductor 18) with a gap 4 between the center RF conductor 18 and the outer ground planes 12. The gap 4 and the width of the center RF conductor 18 primarily dictate the characteristic impedance (approximately 50 Ohms in one embodiment) of the transmission line. There are regions within the ground planes 12 that are open for the bias pads 24 and bias lines 25. The mechanical ground stops 22 preferably extend between adjacent bias pads 24. The center RF conductor 18 beneath the contact beam 10 (i.e., the narrowed section 6 of the center RF conductor 18) narrows to compensate for the additional capacitance provided by the overhanging contact beam 10. Furthermore, the ground straps 28 link the mechanical ground stops 22 to the adjacent sections of the ground planes 12. The thickness of the CPW components preferably exceed the sum thicknesses of the bias pads 24, any passivating dielectric 34 (for example, shown in FIGS. 4(K) and 4(L)) present on the bias pads 24, and the minimum air gap at switch closure between the top of the bias pad 24 and the bottom of the contact beam 10. This minimum air gap is determined by the actuation voltage and the breakdown strength of air within that gap. If the gap is below the minimum value, then electrical breakdown of the air or direct shorting of the bias pads 24 and contact beam 10 (in the dielectric-less bias pad case) can occur. The width of the center RF conductor 18 is preferably approximately 50 microns and the gap 4 between the center RF conductor 18 and the ground planes 12 is approximately 30 microns. The thickness of the CPW transmission line (ground planes 12 and center RF conductor 18) is preferably 0.75 microns. The thickness of the silicon dioxide layer 20 beneath the CPW transmission line is preferably between 0.2 and 0.5 microns. These dimensions, for the materials and thicknesses involved results in a 50 Ohm characteristic impendence of the transmission line.

The bias pads 24 and bias lines 25, which are located in the slots 8 in the ground planes 12, are preferably embodied as rectangular pads and traces, respectively. Preferably, the bias lines 25 and bias pads 24 are thinner, in height, than the surrounding ground planes 12. This ensures that when the contact beam 10 closes, it does not make physical contact with the bias pads 24. This allows for bias pads 24 without dielectric material. As mentioned above, this avoids the common failure mechanism with traditional electrostatic RF MEMS devices—charging of the dielectric that can result in actuation failure. However, even if the bias pads 24 comprised a dielectric layer, the aforementioned air gap mitigates the probability of stiction between the contact beam 10 and the bias pads 24; an advantage afforded by the switch 5 compared with traditional switches.

The bias line air bridge 26 preferably anchors to the bias lines 25 within the ground planes 12 and is elevated above the inner mechanical ground stops 22, the gap 4, and the center RF conductor 18. The bias lines 25 can be passivated with a dielectric to mitigate electrical breakdown between the bias lines 25 and bias pads 24 and ground planes 12. The dielectric covers the bias lines 25 and bias pads 24 and extends beyond the edges of the bias pads 24 and bias lines 25 to the edge of the surrounding ground plane 12 and is patterned with an opening over the anchor region of the bias line air bridge 26. This opening allows for electrical contact between the bias lines 25 and the bias line air bridge 26. The gap 23 between the bias lines 25 and the surrounding ground plane 12 depends upon a number of factors but generally a minimum distance exists that is defined by the electrical breakdown of this gap 23. The minimum distance is preferably approximately 15 microns. The thickness of the bias lines 25 and bias pads 24 is preferably approximately 0.3 microns, and the thickness of the passivating dielectric 34 (for example, shown in FIGS. 4(K) and 4(L)) is preferably between approximately 0.1 and 0.2 microns.

The mechanical ground stops 22 are preferably rectangular sections of the ground planes 12 that extend between the bias pads 24. The ground plane dimples 14 are preferably circular features, and are preferably less than approximately 10 microns in diameter and approximately 0.1 microns in thickness, and are located on the mechanical ground stops 22 that are directly adjacent to the narrowed section 6 of the center RF conductor 18. The number of bias pads 24 and thus the number of mechanical ground stops 22 is primarily determined by the minimum distance between the mechanical ground stops 22 that ensures that the contact beam 10 does not locally collapse onto the bias pads 24. Once the contact beam 10 has closed and is in mechanical contact with the mechanical ground stops 22, the section of the contact beam 10 between any two contacted mechanical ground stops 22 has the potential to collapse onto the bias pad 24. The behavior of this section is generally determined by the minimum closed switch air gap between the contact beam 10 and the bias pad 24, the actuation voltage, the distance between the contacted mechanical ground stops 22, and the material spring constant of the contact beam 10. For a given set of these parameters, the shorter the distance between the contacted stops becomes, the more likely that the contact beam 10 will not collapse upon the bias pad 24. There is a minimum distance at which this occurs and this minimum distance then dictates the number of bias pads 24 and mechanical ground stops 22. Preferably, it is desirable to minimize the number of bias pads 24 and mechanical ground stops 22 as this tends to decrease the total bias pad electrode area.

Figure 6A:
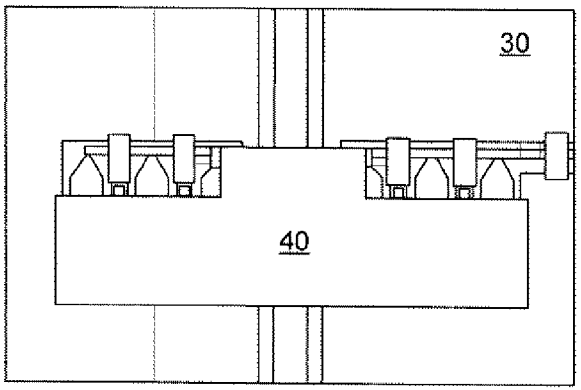
FIGS. 6(A) through 6(F) are schematic diagrams illustrating successive fabrication steps for further manufacturing of the switch of FIG. 1 according to a second embodiment herein.
Figure 6B:
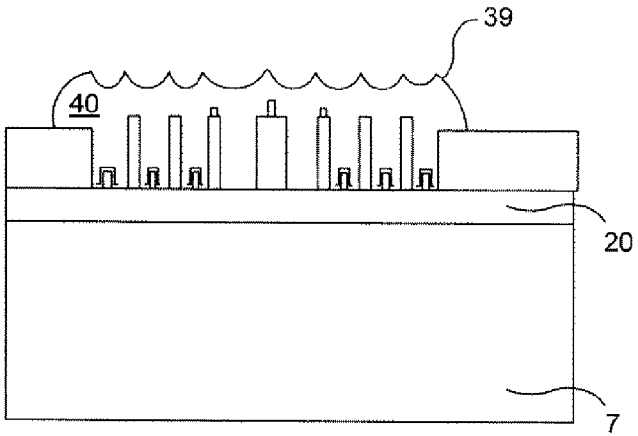

The contact beam 10 is preferably a rectangular beam with an array of etch holes 2 configured within it. The etch holes 2 facilitate the release of the contact beam 10 from the sacrificial layers 36, 40 (of FIGS. 5(A) through 6(D)). The etch holes 2 preferably range in size from approximately 5-10 microns. The contact beam 10 is anchored to the ground planes 12 and is perpendicular to the CPW transmission line as described above. Moreover, the contact beam 10 is elevated above the bias pads 24, mechanical ground stops 22, and the narrowed section 6 of the center RF conductor 18. The anchored regions 21 of the contact beam 10 where it is anchored to the ground planes 12 are preferably rounded to both minimize stress concentration at the location as well as to ensure a consistent thickness of the contact beam 10 near the anchor 21. The rounding is achieved by controlling the underlying sacrificial layer 36 (FIG. 5(A)), 40 (FIG. 6(A)) profile as well as through control of the metal deposition. The contact beam 10 preferably comprises electron beam evaporated pure gold, whereby evaporated deposition tends to deposit material with a high degree of directionality. Thus, the deposited material tends to mimic the underlying topography on which it is being deposited. Without the curvature of the underlying topography, the evaporated material thins significantly near any 90° steps in the topography. This results in undesirable mechanical behavior of the contact beam 10 when the anchors 21 display this thinning. Preferably, the contact beam 10 is approximately 500 microns or less in length, approximately 100 microns or less in width, and approximately between 1-3 microns in thickness.

The contact dimples 14, 16 are preferably approximately five microns in diameter or less. The height of the RF dimples 16 preferably exceed the height of the ground plane dimples 14 to ensure that during mechanical switch closure, both sets of contact dimples 14, 16 are closed. The preferable height of the RF dimples is approximately 0.5 microns.

The fabrication of the switch 5 is shown in the successive fabrication steps of FIGS. 4(A) through 6(F), with the thicknesses given below being approximate thicknesses. As shown in the top down view of FIG. 4(A) and the profile view of FIG. 4(B), the starting material of the switch 5 (of FIGS. 1 through 3) is the substrate 7, which comprises a single crystal silicon wafer with a resistivity greater than 10 kOhm-cm for reasonable high frequency performance. Other possible substrates 7 include sapphire, Z-cut quartz, gallium arsenide, as well as others. Next, as shown in the top down view of FIG. 4(C) and the profile view of FIG. 4(D), plasma enhanced chemical vapor deposition (PECVD) of $SiO_2$ 20 (approximately 2,000 Å-5,000 Å) occurs in an approximately 700° C., $N_2$ atmosphere, at an approximate annealing time of 60 seconds.

Figure 4A:
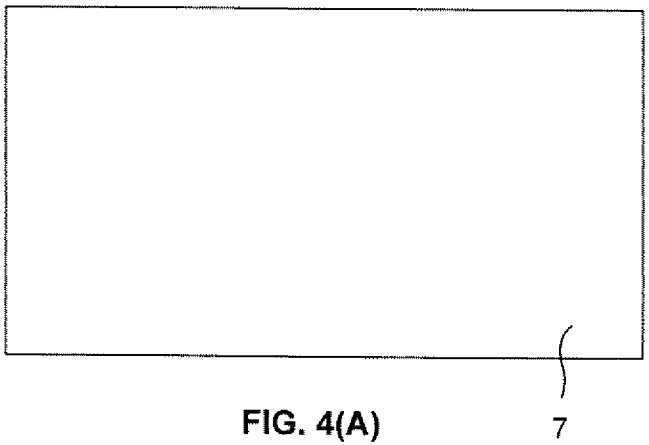
FIGS. 4(A) through 4(N) are schematic diagrams illustrating successive fabrication steps for manufacturing the switch of FIG. 1 according to an embodiment herein.
Figure 4B:
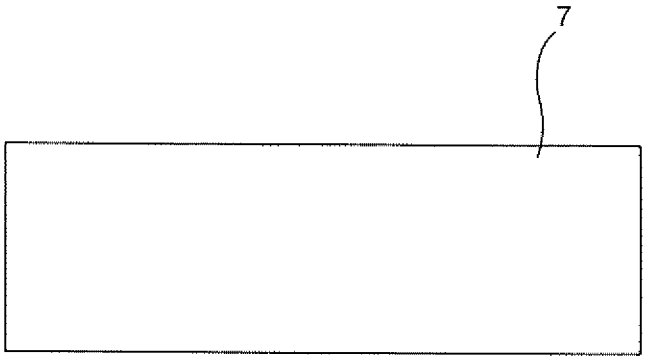
Figure 4C:
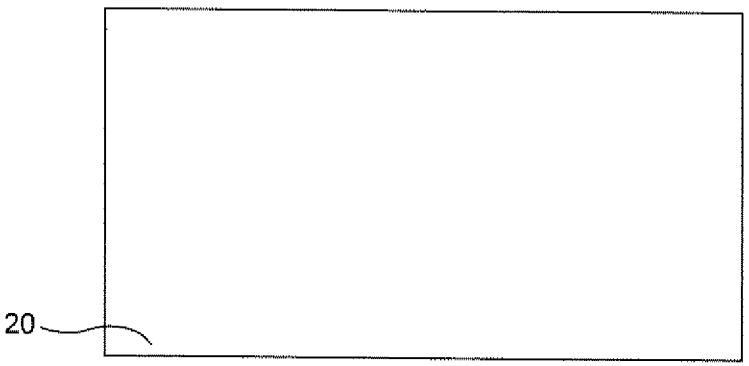
Figure 4D:
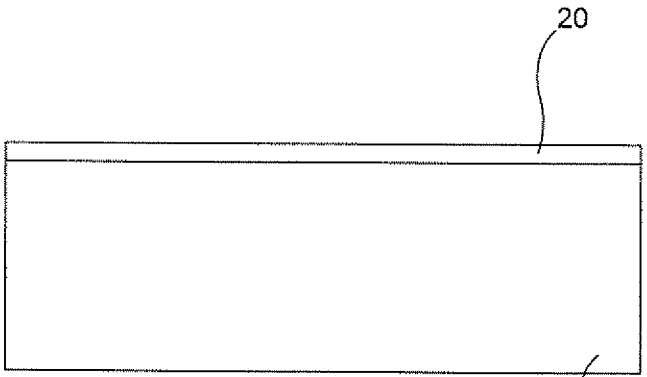
Figure 4F:
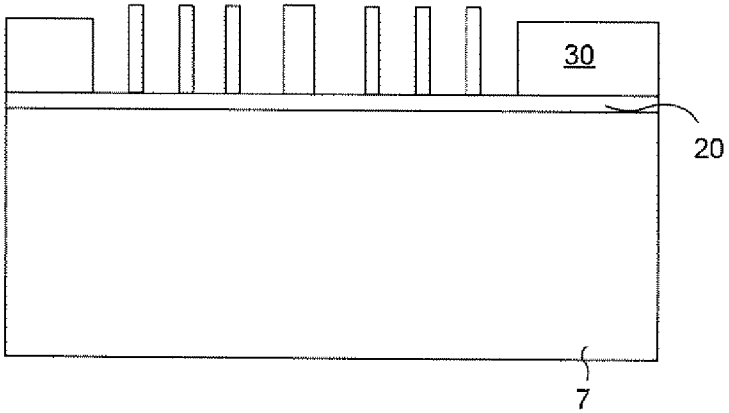
Figure 4E:
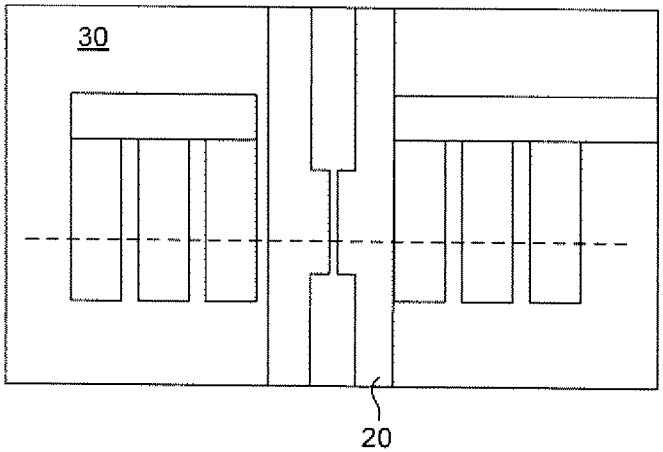
Figure 4H:
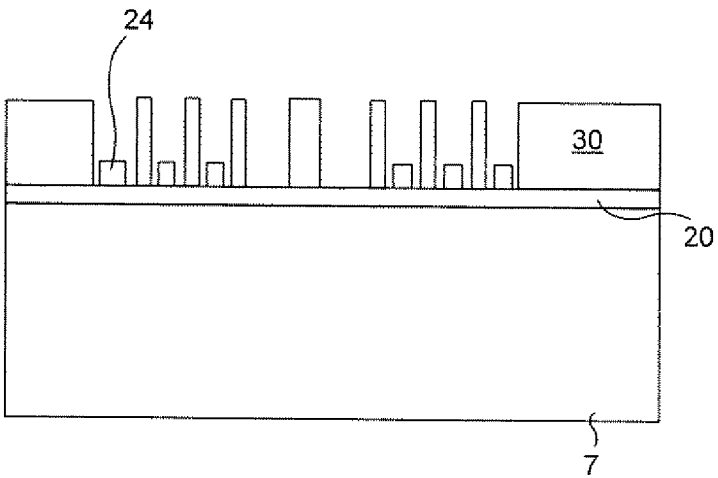
Figure 4G:
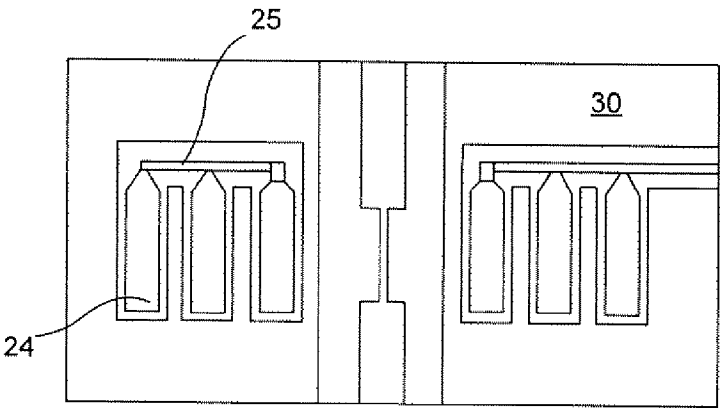
Figure 4J:
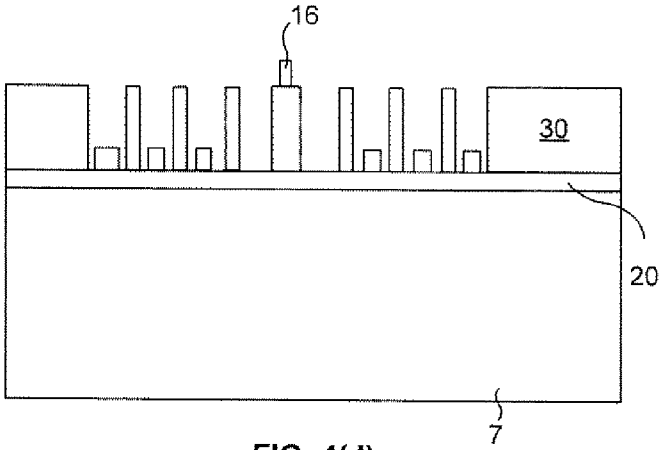

After this, as shown in the top down view of FIG. 4(E) (the dashed line in FIG. 4(E) indicates the cross-sectional views illustrated in all subsequent profile views) and the profile view of FIG. 4(F), a liftoff process occurs with evaporated Ti/Au 30 (approximately 200 Å/7,300 Å) to define the CPW transmission line (ground planes 12 and center RF conductor 18). As shown in the top down view of FIG. 4(G) and the profile view of FIG. 4(H), a liftoff process occurs with evaporated Ti/Au/Pt (approximately 200 Å/1,800 Å/1,000 Å) to define the bias pads 24 and bias lines 25 (of FIG. 1). Thereafter, as shown in the top down view of FIG. 4(I) and the profile view of FIG. 4(J), a liftoff process occurs with evaporated Au/Pt (approximately 4,000 Å/1,000 Å) to define the RF dimples 16.

Figure 4L:
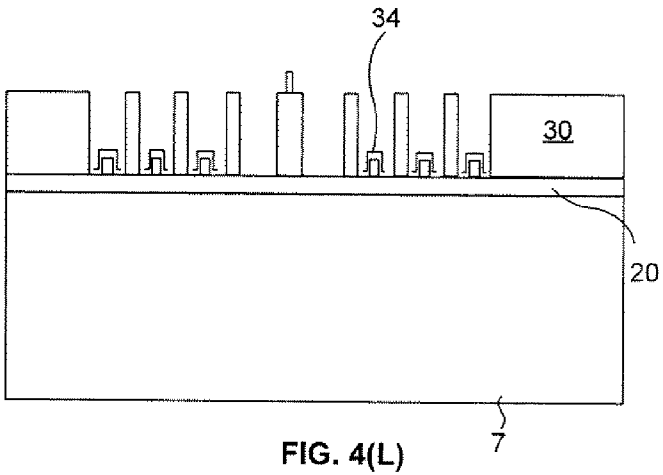
Figure 4I:
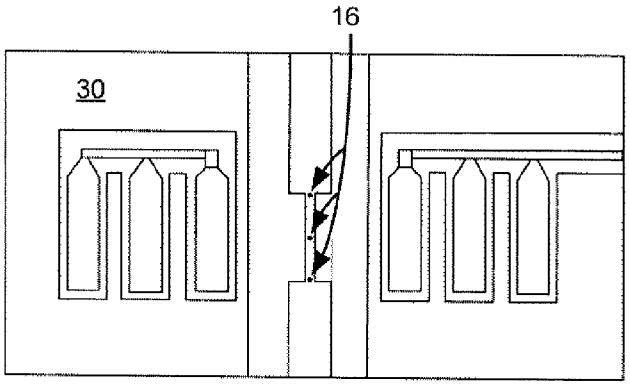
Figure 4K:
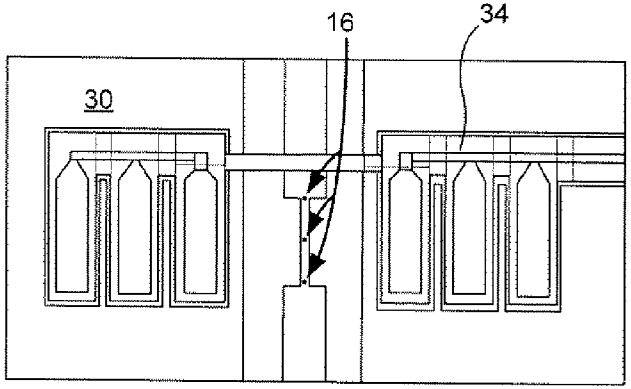
Figure 4N:
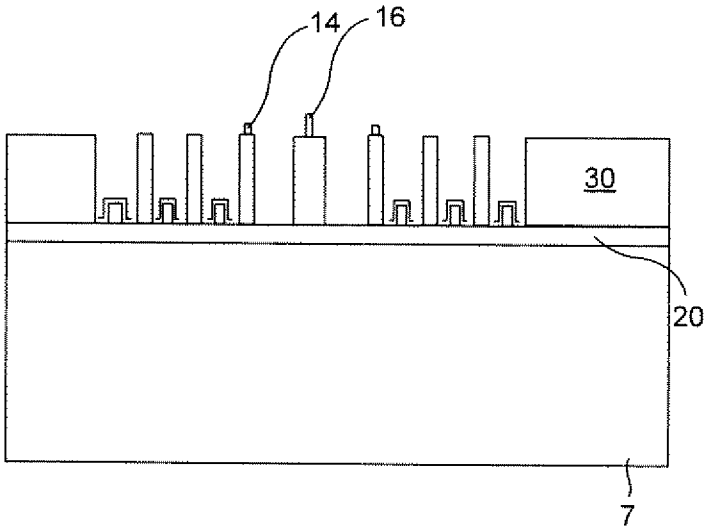
Figure 4M:
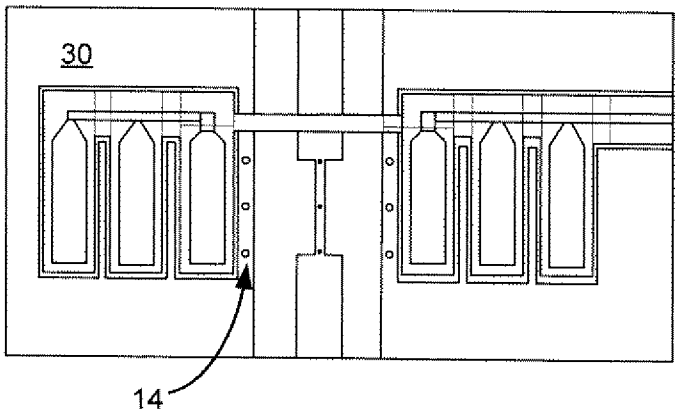
Figure 5A:
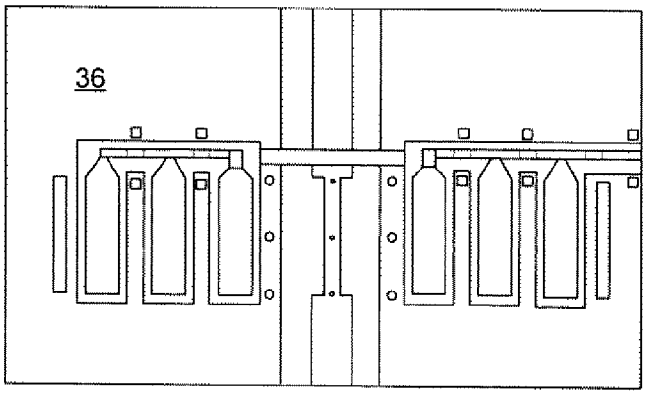
FIGS. 5(A) through 5(H) are schematic diagrams illustrating successive fabrication steps for further manufacturing of the switch of FIG. 1 according to a first embodiment herein.
Figure 5C:
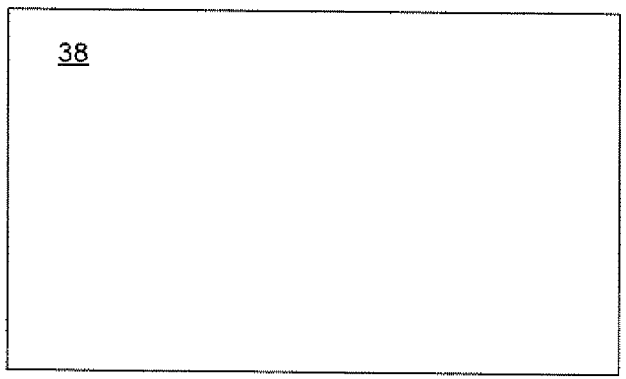
Figure 5B:
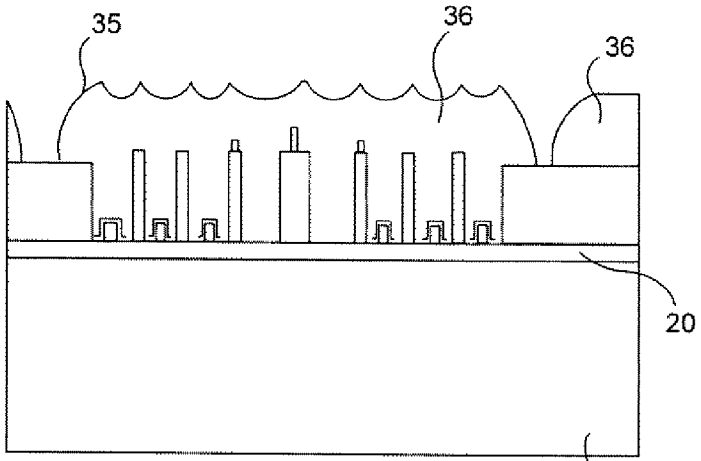
Figure 5D:
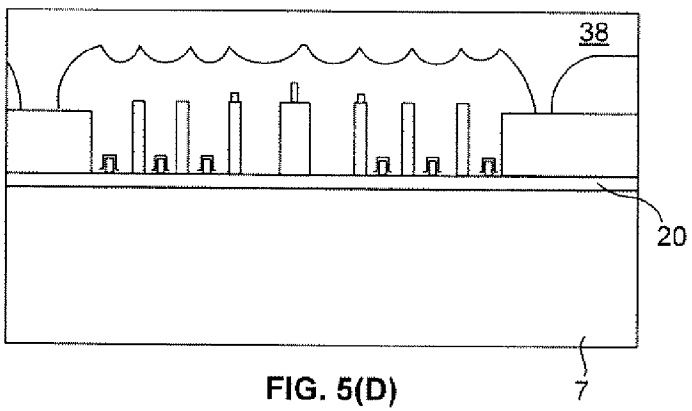
Figure 5F:
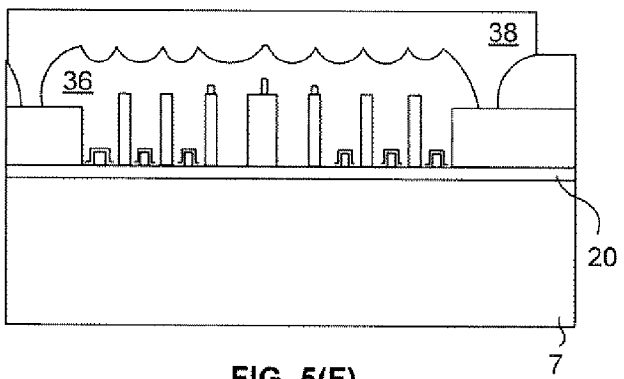
Figure 5H:
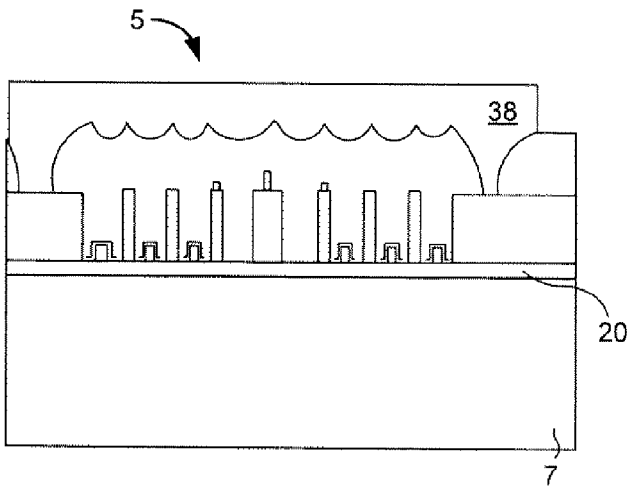
Figure 5E:
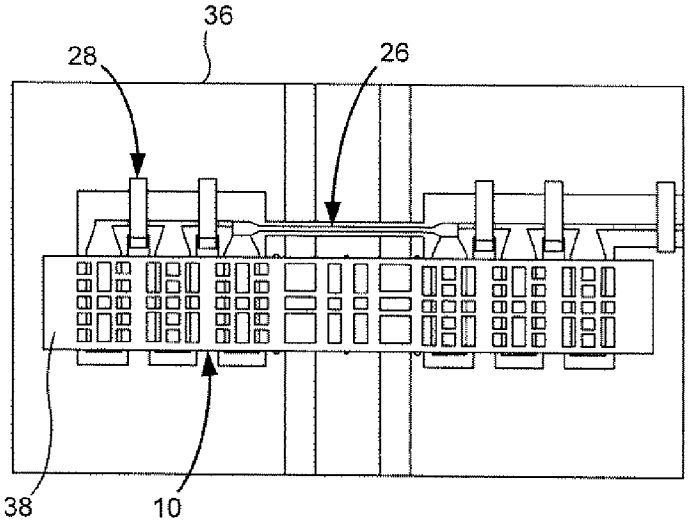
Figure 5G:
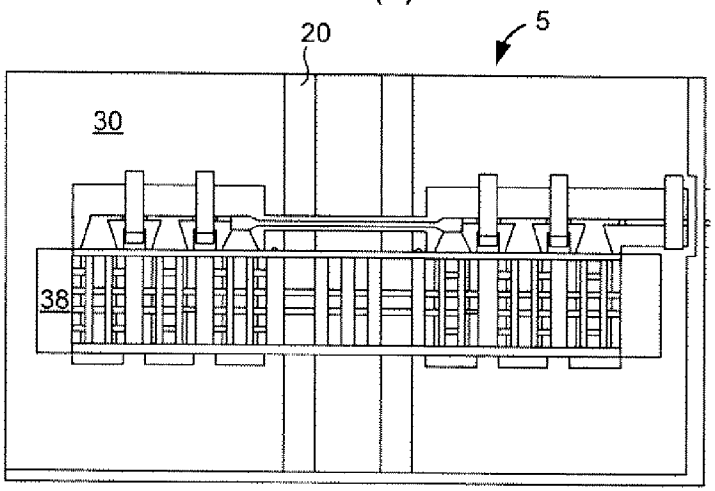

Next, as shown in the top down view of FIG. 4(K) and the profile view of FIG. 4(L), PECVD of $Si_3N_4/SiO_2$ 34 (approximately 500 Å/1,000 Å) occurs followed by a reactive ion etch (RIE) patterning process of the $Si_3N_4/SiO_2$ 34. After this, as shown in the top down view of FIG. 4(M) and the profile view of FIG. 4(N), a liftoff process occurs with evaporated Au/Pt or Ti/Pt (approximately 200 Å/800 Å) to define the ground plane dimples 14.

The remaining processing steps are subject to two different process sequences. The first process is shown sequentially in FIGS. 5(A) through 5(H) and utilizes ion milling of a conformal gold layer 38 to pattern the contact beam 10. The second process is shown sequentially in FIGS. 6(A) through 6(F) and utilizes a liftoff step for the patterning of the contact beam 10. Both embodiments are valid, however the liftoff process has certain advantages. In particular, the liftoff process generally results in a substantially cleaner process (beneficial to reliability and process yield).

FIGS. 5(A) through 5(H) illustrate the first process (ion milling steps) that concludes the total fabrication process for manufacturing the switch 5. As shown in the top down view of FIG. 5(A) and the profile view of FIG. 5(B), a sacrificial layer (photoresist) 36 deposition and patterning process occurs. The patterning opens vertical posts for the contact beam 10, the bias line air bridge 26, and the ground straps 28. The rounding of the edges 35 of the sacrificial photoresist layer 36 is accomplished by baking the photoresist 36 at approximately 175° C. Moreover, the hardening of the sacrificial layer 36 is accomplished by ultraviolet (UV) radiation in a process known as UV curing. Upon completion of this step, as shown in the top down view of FIG. 5(C) and the profile view of FIG. 5(D), a deposition of electron beam evaporated pure Au 38 (approximately 10,000 Å-30,000 Å) occurs. As shown in the top down view of FIG. 5(E) and the profile view of FIG. 5(F), an ion mill patterning of the Au 38 occurs to define the contact beam 10, the ground straps 28, and the bias line air bridge 26. Next, as shown in the top down view of FIG. 5(G) and the profile view of FIG. 5(H), the switch 5 is released, whereby the ultra-violet hardened sacrificial photoresist layer 36 is removed in an oxygen plasma ash process.

FIGS. 6(A) through 6(F) illustrate the second process (liftoff process) that concludes the total fabrication process for manufacturing the switch 5. First, as shown in the top down view of FIG. 6(A) and the profile view of FIG. 6(B), a sacrificial photoresist layer 40 is deposited and patterned. The patterning leaves regions of photoresist 40 beneath the contact beam 10, the ground straps 28, and the bias line air bridge 26. The sacrificial layer 40 typically has a 15 micron offset from the edge of the relevant features; i.e., contact beam 10, ground straps 28, and bias line air bridge 26. Rounding of the edges 39 of the sacrificial layer 40 is accomplished by baking the photoresist 36 at approximately 175° C. The hardening of the sacrificial layer 40 is accomplished by UV radiation (UV curing), and the photolithographic patterning of the contact beam 10, ground straps 28, and bias line air bridge 26 occurs that opens these features to the sacrificial layer 40 beneath and covers all remaining features.

Figure 6C:
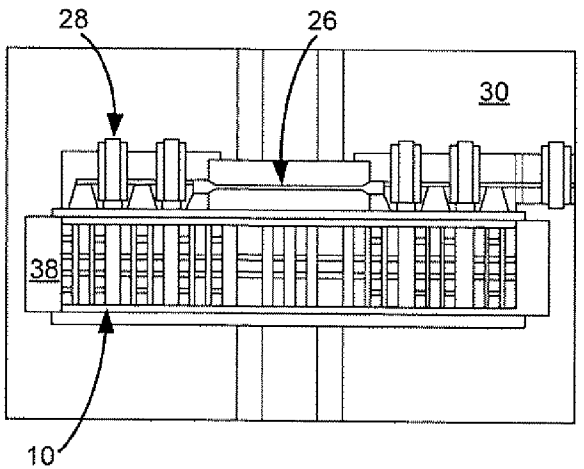
Figure 6D:
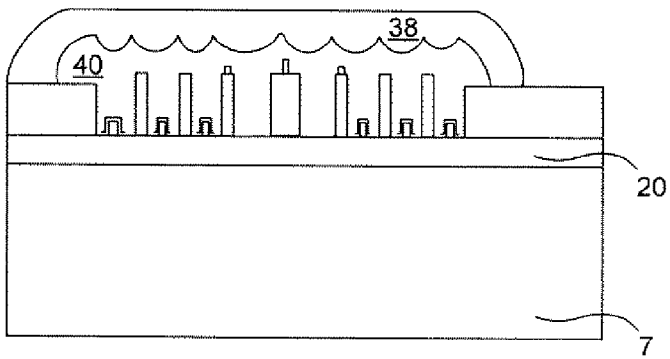
Figure 6:
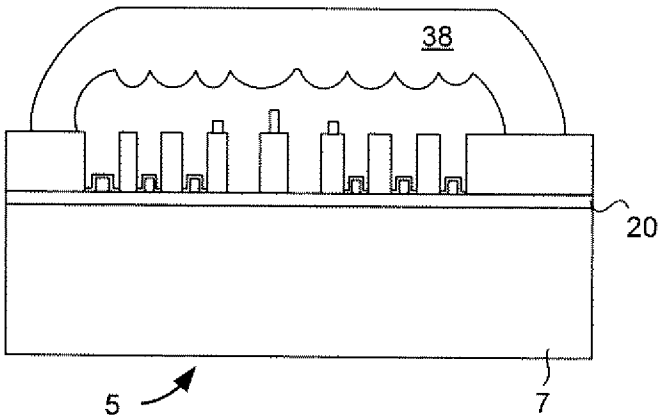
Figure 6E:
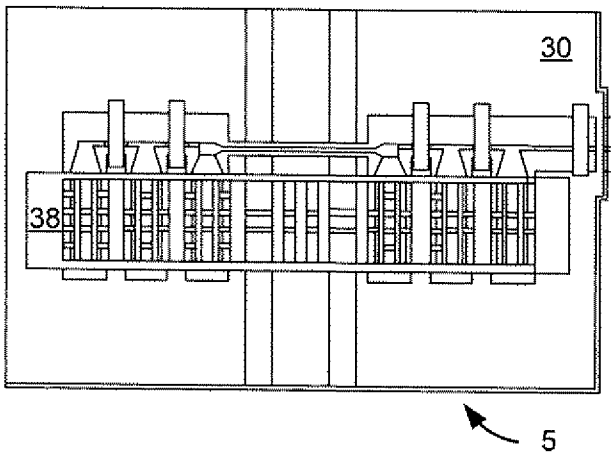

As shown in the top down view of FIG. 6(C) and the profile view of FIG. 6(D), the deposition of electron beam evaporated pure Au 38 (approximately 10,000 Å-30,000 Å) occurs followed by a liftoff process to define the contact beam 10, ground straps 28, and bias line air bridge 26, preferably utilizing acetone as the removal agent. This ensures that the UV hardened photoresist 40 remains while the photoresist (not shown) utilized for the liftoff procedure is completely removed. The contact beam 10, ground straps 28, and bias line air bridge 26 are therefore not released from the wafer surface (substrate 7) and not subject to stiction. The switch 5 is released, as shown in the top down view of FIG. 6(E) and the profile view of FIG. 6(F) when the UV hardened sacrificial photoresist layer 40 is removed in an oxygen plasma ash process.

Figure 7:
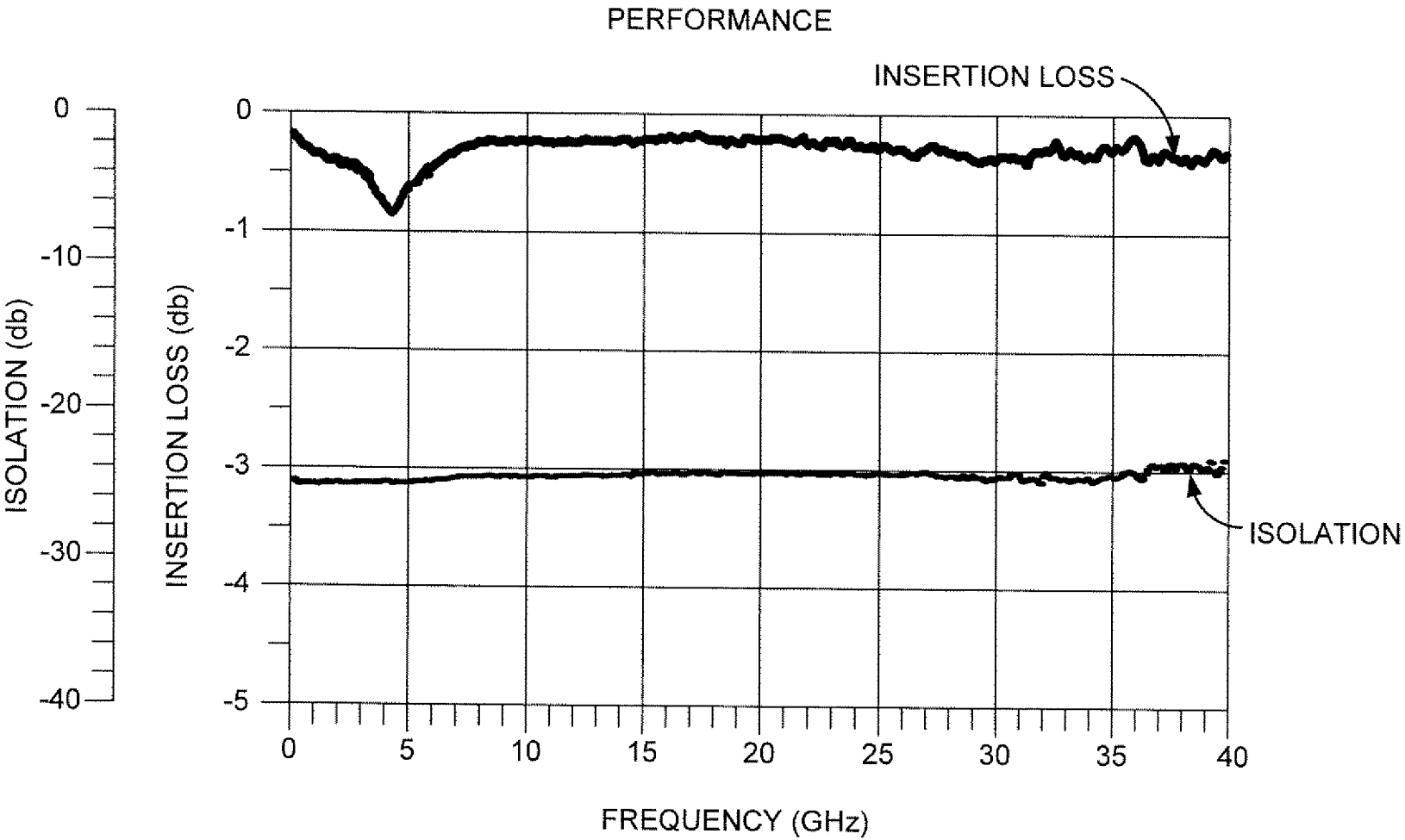
FIG. 7 is a graphical representation illustrating experimental results relating to the testing of the switch of FIG. 1 according to an embodiment herein.

FIG. 7 illustrates experimental results of the switch 5. RF systems require an insertion loss greater than −0.5 dB along with an isolation less than −20 dB. As shown in FIG. 7, over a 0-40 GHz range of frequency, the insertion loss of the switch 5 is generally constant (and negligible), approximately −0.25 dB. These values are very typical for properly designed RF MEMS switches. Furthermore, over a 0-40 GHz range of frequency, the isolation of the switch 5 is also generally constant, between approximately −23 dB and −26 dB.

Figure 8:
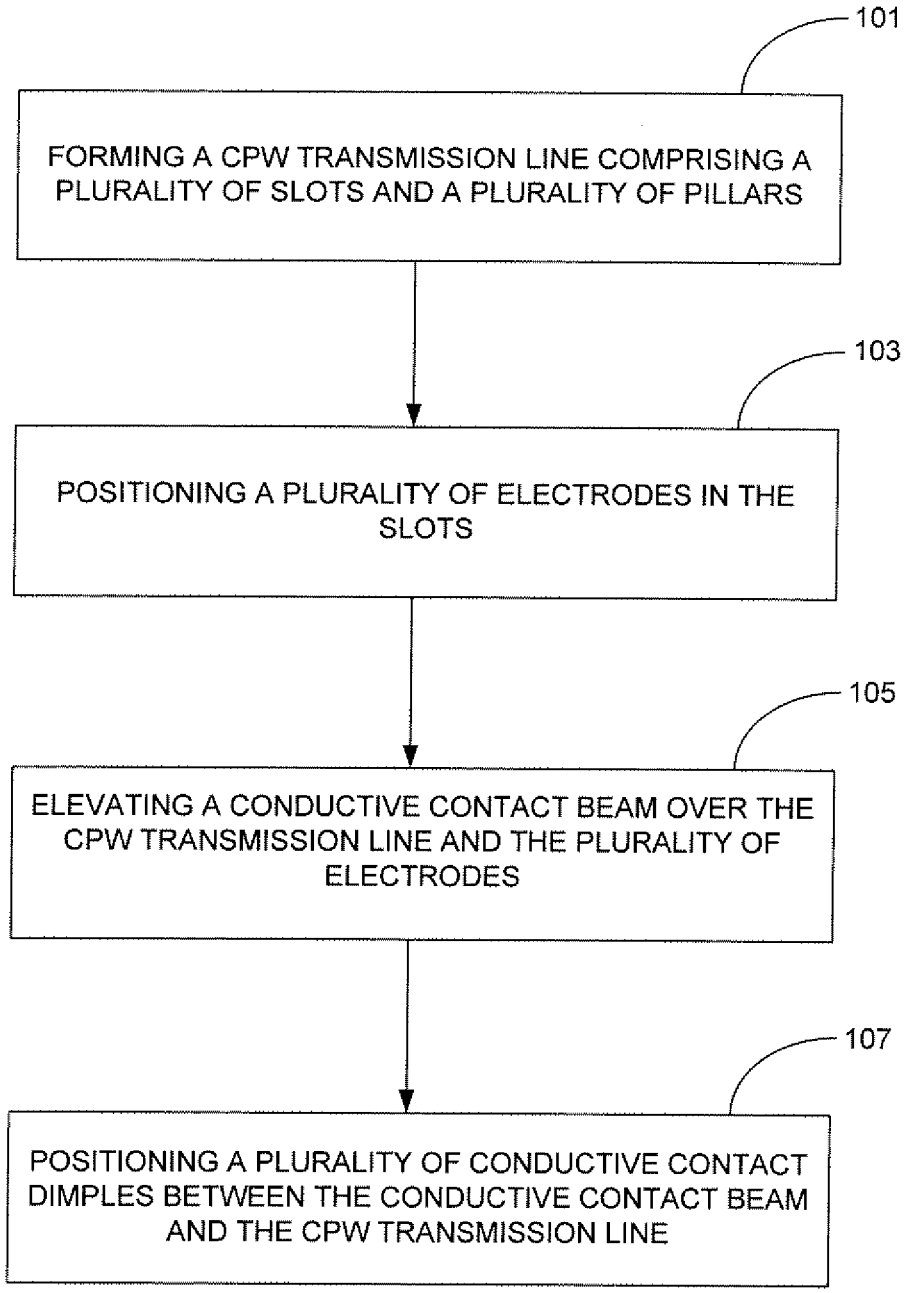
FIG. 8 is a flow diagram illustrating a preferred method according to an embodiment herein.

FIG. 8, with reference to FIGS. 1 through 7, is a flow diagram illustrating a method of manufacturing an electrostatic ohmic shunt RF MEMS switch 5 according to an embodiment herein, wherein the method comprises forming (101) a CPW transmission line (the CPW RF transmission line comprises the ground planes 12 and a center RF conductor 18) comprising a plurality of slots 8 and a plurality of pillars 22, wherein a space between successive ones of the plurality of pillars 22 is defined by one of the plurality of slots 8; positioning (103) a plurality of electrodes 24 in the slots 8; elevating (105) a conductive contact beam 10 over the CPW transmission line (ground planes 12+center RF conductor 18) and the plurality of electrodes 24; and positioning (107) a plurality of conductive contact dimples 14, 16 between the conductive contact beam 10 and the CPW transmission line (ground planes 12+center RF conductor 18), wherein the plurality of pillars 22 are adapted to prevent physical contact between the plurality of electrodes 24 and the conductive contact beam 10.

The forming of the CPW transmission line (ground planes 12+center RF conductor 18) comprises configuring a centrally located and structurally continuous RF conductor 18; flanking a pair of conductor ground planes 12 adjacent to the RF conductor 18, wherein the pair of conductor ground planes 12 comprise a first ground plane and a second ground plane each comprising the plurality of slots 8 configured therein; and configuring a plurality of ground straps 28 to tie adjacent sections of the pair of conductor ground planes 12 together, wherein the contact beam 10 is attached to the pair of conductor ground planes 12. The method may further comprise forming a bias line 25 to connect the plurality of electrodes 24 to one another. Moreover, the method may further comprise forming a bias line air bridge 26 to connect the plurality of electrodes 24 and the bias line 25 located on the first ground plane 12 to the plurality of electrodes 24 and the bias line 25 located on the second ground plane 12.

Preferably, the plurality of conductive contact dimples 14, 16 are adapted to transmit electric current between the conductive contact beam 10 and the CPW transmission line (ground planes 12+center RF conductor 18) when voltage is applied between the pair of conductor ground planes 12 and the plurality of electrodes 24. Additionally, the RF conductor 18 preferably comprises a narrowed central portion 6 located underneath the contact beam 10 to reduce an excess capacitance induced by the contact beam 10, and wherein the plurality of conductive contact dimples comprise a first set of conductive contact dimples 14 adapted to connect the pair of conductor ground planes 12 with the contact beam 10; and a second set of conductive contact dimples 16 adapted to connect the RF conductor 18 with the contact beam 10, wherein the first set of conductive contact dimples 14 are adapted to reduce a parasitic inductance induced by the contact beam 10.

The miniaturization thus far of RF circuits has been exploited by the cellular phone and wireless products markets. Military communications and radar systems also benefit from the further miniaturization of RF circuits. Accordingly, the high performance RF MEMS switch 5 provided by the embodiments herein enable low loss and low cost RF phase shifters for Electronic Scanning Antenna (ESA) applications, reconfigurable antenna, RF seekers, ground-based radars, and millimeter wave (MMW) sensor components.

The electrostatic ohmic shunt RF MEMS switch 5 provides for an extremely low, nearly immeasurable, insertion loss, and allows for a greatly increased device lifetime because no contact occurs between the bias pads 24 and the contact beam 10, and because of the ability for eliminating the dielectric 34 on the bias pads 24 altogether. Moreover, the switch 5 mitigates and potentially eliminates the primary failure mechanism associated with traditional (capacitive) electrostatic shunt switches. The electrostatic isolation of the switch 5 at DC is comparable to isolation at 40 GHz. This kind of performance is extremely uncommon in MEMS switches. Furthermore, the switch 5 may be ideally suited for high frequency operation (W band, 75-111 GHz).

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. An electrostatic ohmic shunt radio frequency (RF) microelectromechanical system (MEMS) switch comprising:

a centrally located and structurally continuous RF conductor;

a pair of conductor ground planes flanking said RF conductor, wherein said pair of conductor ground planes comprise a first ground plane and a second ground plane each comprising a plurality of slots configured therein;

a plurality of electrodes positioned in said slots;

a conductive contact beam elevated over said RF conductor, said pair of conductor ground planes, and said plurality of electrodes, wherein said contact beam is attached to said pair of conductor ground planes;

a plurality of mechanical ground stops extending from said pair of conductor ground planes, wherein a space between successive ones of said plurality of mechanical ground stops is defined by one of said plurality of slots, wherein during activation of the switch, when said conductive contact beam is pulled toward said plurality of electrodes, said plurality of mechanical ground stops prevent physical contact between said plurality of electrodes and said conductive contact beam; and a plurality of conductive contact dimples positioned between said conductive contact beam and each of said RF conductor and said pair of conductor ground planes.

2. The switch of claim 1, further comprising a plurality of ground straps adapted to tie adjacent sections of said pair of conductor ground planes together.

3. The switch of claim 1, further comprising a bias line adapted to connect said plurality of electrodes to one another.

4. The switch of claim 2, further comprising a bias line air bridge adapted to connect said plurality of electrodes and said bias line located on said first ground plane to said plurality of electrodes and said bias line located on said second ground plane.

5. The switch of claim 1, wherein said plurality of conductive contact dimples are adapted to transmit electric current between said conductive contact beam and each of said RF conductor and said pair of conductor ground planes when voltage is applied between said pair of conductor ground planes and said plurality of electrodes.

6. The switch of claim 1, wherein said RF conductor comprises a narrowed central portion located underneath said contact beam to reduce an excess capacitance induced by said contact beam.

7. The switch of claim 1, wherein said plurality of conductive contact dimples comprise:

a first set of conductive contact dimples adapted to connect said pair of conductor ground planes with said contact beam; and a second set of conductive contact dimples adapted to connect said RF conductor with said contact beam, wherein said first set of conductive contact dimples are adapted to reduce a parasitic inductance induced by said contact beam.

8. An electrostatic ohmic shunt radio frequency (RF) microelectromechanical system (MEMS) switch comprising:

a co-planar waveguide (CPW) transmission line comprising a plurality of slots and a plurality of pillars, wherein a space between successive ones of said plurality of pillars is defined by one of said plurality of slots;

a plurality of electrodes positioned in said slots;

a conductive contact beam elevated over said CPW transmission line and said plurality of electrodes; and a plurality of conductive contact dimples positioned between said conductive contact beam and said CPW transmission line, wherein during activation of the switch, when said conductive contact beam is pulled toward said plurality of electrodes, said plurality of pillars prevent physical contact between said plurality of electrodes and said conductive contact beam.

9. The switch of claim 8, wherein said CPW transmission line comprises:

a centrally located and structurally continuous RF conductor;

a pair of conductor ground planes flanking said RF conductor, wherein said pair of conductor ground planes comprise a first ground plane and a second ground plane each comprising said plurality of slots configured therein; and a plurality of ground straps adapted to tie adjacent sections of said pair of conductor ground planes together, wherein said contact beam is attached to said pair of conductor ground planes.

10. The switch of claim 8, further comprising a bias line adapted to connect said plurality of electrodes to one another.

11. The switch of claim 9, further comprising a bias line air bridge adapted to connect said plurality of electrodes and said bias line located on said first ground plane to said plurality of electrodes and said bias line located on said second ground plane.

12. The switch of claim 9, wherein said plurality of conductive contact dimples are adapted to transmit electric current between said conductive contact beam and said CPW transmission line when voltage is applied between said pair of conductor ground planes and said plurality of electrodes.

13. The switch of claim 9, wherein said RF conductor comprises a narrowed central portion located underneath said contact beam to reduce an excess capacitance induced by said contact beam.

14. The switch of claim 9, wherein said plurality of conductive contact dimples comprise:

a first set of conductive contact dimples adapted to connect said pair of conductor ground planes with said contact beam; and a second set of conductive contact dimples adapted to connect said RF conductor with said contact beam, wherein said first set of conductive contact dimples are adapted to reduce a parasitic inductance induced by said contact beam.

15. A method of manufacturing an electrostatic ohmic shunt radio frequency (RF) microelectromechanical system (MEMS) switch, said method comprising:

forming a co-planar waveguide (CPW) transmission line comprising a plurality of slots and a plurality of pillars, wherein a space between successive ones of said plurality of pillars is defined by one of said plurality of slots;

positioning a plurality of electrodes in said slots;

elevating a conductive contact beam over said CPW transmission line and said plurality of electrodes; and positioning a plurality of conductive contact dimples between said conductive contact beam and said CPW transmission line, wherein during activation of the switch, when said conductive contact beam is pulled toward said plurality of electrodes, said plurality of pillars prevent physical contact between said plurality of electrodes and said conductive contact beam.

16. The method of claim 15, wherein the forming of said CPW transmission line comprises:

configuring a centrally located and structurally continuous RF conductor;

flanking a pair of conductor ground planes adjacent to said RF conductor, wherein said pair of conductor ground planes comprise a first ground plane and a second ground plane each comprising said plurality of slots configured therein; and configuring a plurality of ground straps to tie adjacent sections of said pair of conductor ground planes together, wherein said contact beam is attached to said pair of conductor ground planes.

17. The method of claim 15, further comprising forming a bias line to connect said plurality of electrodes to one another.

18. The method of claim 16, further comprising forming a bias line air bridge to connect said plurality of electrodes and said bias line located on said first ground plane to said plurality of electrodes and said bias line located on said second ground plane.

19. The method of claim 16, wherein said plurality of conductive contact dimples are adapted to transmit electric current between said conductive contact beam and said CPW transmission line when voltage is applied between said pair of conductor ground planes and said plurality of electrodes.

20. The method of claim 16, wherein said RF conductor comprises a narrowed central portion located underneath said contact beam to reduce an excess capacitance induced by said contact beam, and wherein said plurality of conductive contact dimples comprise:

a first set of conductive contact dimples adapted to connect said pair of conductor ground planes with said contact beam; and a second set of conductive contact dimples adapted to connect said RF conductor with said contact beam, wherein said first set of conductive contact dimples are adapted to reduce a parasitic inductance induced by said contact beam.

* * * * *